US005795247A

United States Patent [19]

Yokota et al.

[11] Patent Number: 5,795,247

[45] Date of Patent: Aug. 18, 1998

[54] SOLID GOLF BALL

[75] Inventors: Masatoshi Yokota; Keiji Moriyama, both of Shirakawa; Satoshi Iwami, Himeji, all of Japan

[73] Assignee: Sumitomo Rubber Industries, Ltd., Hyogo-ken, Japan

[21] Appl. No.: 628,341

[22] Filed: Apr. 5, 1996

[30] Foreign Application Priority Data

Apr. 5, 1995 [JP] Japan ..... 7-106910

[51] Int. Cl.[6] ..... A63B 37/06; A63B 37/12

[52] U.S. Cl. ..... 473/374; 473/377; 473/378

[58] Field of Search ..... 473/377, 351.1, 473/374, 378

[56] References Cited

U.S. PATENT DOCUMENTS 5,368,304 11/1994 Sullivan et al. ..... 473/377
5,439,227 8/1995 Egashira et al. ..... 473/377 X

FOREIGN PATENT DOCUMENTS 625363 5/1994 European Pat. Off. .
637459 2/1995 European Pat. Off. .
2294054 4/1996 United Kingdom .

*Primary Examiner*—George J. Marlo
*Attorney, Agent, or Firm*—Birch, Stewart, Kolasch & Birch, LLP

[57] ABSTRACT

The present invention provides a solid golf ball which is superior in shot feel (feeling at the time of hitting) and attains a longer flight distance. The solid golf ball of the present invention comprises a core and a cover covering the core, wherein, when a compression deformation formed by applying a load from 10 kg (initial load) to 130 kg (final load) to the core is taken as compression deformation A and a compression deformation formed by applying a load from 10 kg (initial load) to 130 kg (final load) to the golf ball is taken as compression deformation B, the difference (A–B) between compression deformation A and compression deformation B falls within the range of 1.0 to 3.5 mm. The diameter of the core is within the range of 33.7 to 38.1 mm.

2 Claims, 2 Drawing Sheets

SOLID GOLF BALL

FIELD OF THE INVENTION

The present invention relates to a solid golf ball. More particularly, it relates to a solid golf ball which is superior in shot feel (feel at the time of hitting) and attains longer flight distance.

BACKGROUND OF THE INVENTION

A solid golf ball, e.g. a two-piece solid golf ball, when hit, exhibits a straight trajectory, because its spin amount is smaller than that of a thread wound golf ball and, therefore, flight distance is longer. However, almost all of golfers desire to further increase flight distance. Also shot feel has been recently considered to be important. Therefore, a golf ball having both long flight distance and good shot feel is desired.

However, the solid golf ball generally has a hard and poor shot feel, which must to be improved.

OBJECTS OF THE INVENTION

The main object of the present invention is to provide a solid golf ball having good shot feel and long flight distance.

This object as well as other objects and advantages of the present invention will become apparent to those skilled in the art from the following description with reference to the accompanying drawings.

The present invention will become more fully understood from the detailed description given hereinbelow and the accompanying drawings which are given by way of illustration only, and thus, are not limitative of the present invention, and wherein:

SUMMARY OF THE INVENTION

Figure 1:
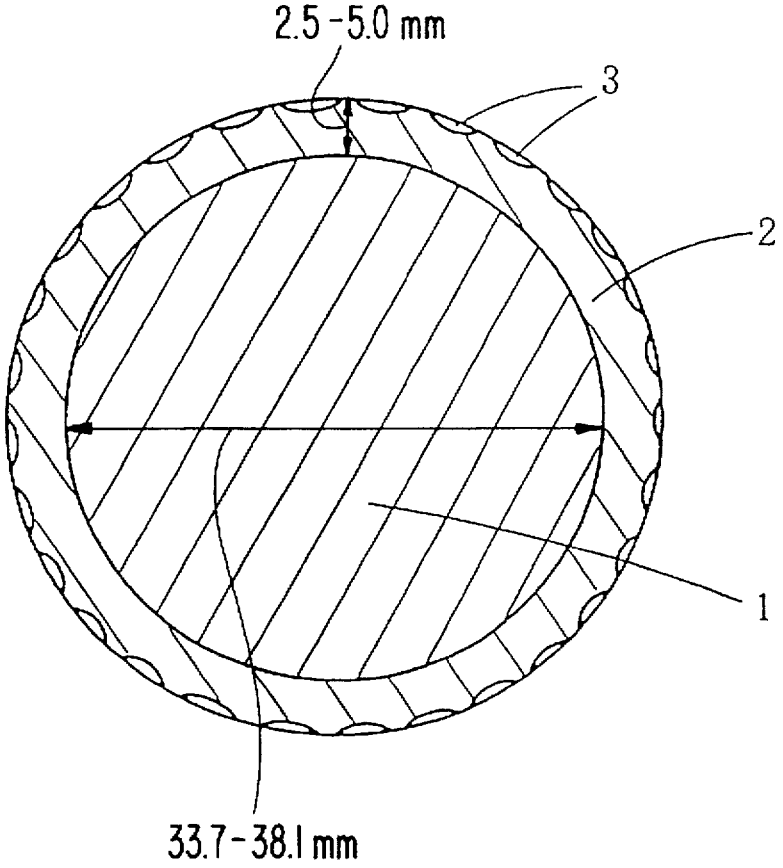
FIG. 1 is a schematic cross section illustrating one embodiment of the solid golf ball of the present invention.

The present invention provides a solid golf ball comprising a core and a cover covering the core, wherein, when a compression deformation formed by applying a load from 10 kg (initial load) to 130 kg (final load) to the core is taken as the compression deformation A and a compression deformation formed by applying a load from 10 kg (initial load) to 130 kg (final load) to the golf ball is taken as the compression deformation B, a difference (A–B) between compression deformation A and compression deformation B is within the range of 1.0 to 3.5 mm.

DETAILED DESCRIPTION OF THE INVENTION

The reason why shot feel and flight distance can be improved by using the above construction in the present invention is as follows.

Flight distance of a golf ball is largely influenced by the initial velocity, launch angle and spin. In the present invention, the launch angle is increased and the spin amount is decreased by increasing the difference between the compression deformation of the core and that of the golf ball, thereby improving flight distance. It is considered that shot feel is also improved by the fact that the golf ball is suitably deformed when hitting and the time of contact between the golf ball and golf club is proper. According to the study conducted by the present inventors, golf balls which have been commercially available the market all fall in outside the range of the compression deformation difference of the present invention.

In the present invention, the difference (A–B) between the compression deformation A formed by applying a load from 10 kg (initial load) to 130 kg (final load) to the core and compression deformation B formed by applying a load from 10 kg (initial load) to 130 kg (final load) and to the golf ball is adjusted within the range of 1.0 to 3.5 mm. In the present invention, the reason why the difference (A–B) between the compression deformation`A of the core and compression deformation B of the golf ball is adjusted within the range of 1.0 to 3.5 mm is as follows. When the difference (A–B) between the compression deformation A of the core and compression deformation B of the golf ball is smaller than 1.0 mm, the launch angle and the spin amount are both lowered, so that the flight distance and shot feel are not improved. On the other hand, when the difference (A–B) between the compression deformation A of the core and compression deformation B of the golf ball exceeds 3.5 mm, the difference between the compression deformation A of the core and compression deformation B of the golf ball is too large and, therefore, the shot feel is inferior and the durability is inferior. Only when the difference (A–B) between the compression deformation A of the core and compression deformation B of the golf ball is within the range of 1.0 to 3.5 mm, is the shot feel good and the flight distance improved.

The core may be any one in which the difference (A–B) between the compression deformation A of the core and compression deformation B of the golf ball is within the range of 1.0 to 3.5 mm, but is generally composed of a vulcanized molded rubber composition. As the base rubber of the rubber composition, various rubbers such as natural rubber, synthetic rubber, etc. can be used. Among them, polybutadiene, particularly a high-cis polybutadiene containing at least 40% of a cis-structure is preferred.

The above rubber composition for the core is prepared by formulating co-crosslinking agents, initiators, fillers, etc. to the above base rubber. In addition, chemicals such as antioxidants, color powders etc. may be formulated in the above rubber composition for core.

Examples of the co-crosslinking agents are metal salts of an α,β-carboxylic acid, especially monovalent or divalent metal salts (e.g. zinc salt, magnesium salt, etc.) of α,β-unsaturated carboxylic acids having 3 to 8 carbon atoms (e.g. acrylic acid, methacrylic acid, etc.). Among them, zinc acrylate is particularly preferred. An amount of the co-crosslinking agent is preferably 5 to 50 parts by weight, particularly 10 to 35 parts by weight, based on 100 parts by weight of the base rubber.

Examples of the initiators are organic peroxides, such as dicumyl peroxide, 1,1-bis(t-butylperoxy)-3,3,5-trimethylcyclohexane, 2,5-dimethyl-2,5-di(t-butylperoxy) hexane, 1,3-(t-butylperoxyisopropyl)benzene, etc. Among them, dicumyl peroxide is particularly preferred. An amount of the initiator is preferably 0.3 to 5 parts by weight, particularly 0.5 to 2.5 parts by weight, based on 100 parts by weight of the base rubber.

The filler can be those generally used in this field, for example zinc oxide, barium sulfate, calcium carbonate and the like. An amount of the filler is not specifically limited, but is preferably 10 to 60 parts by weight, based on 100 parts by weight of the base rubber.

The core can be obtained by subjecting the above rubber composition for core to vulcanizing (crosslinking) molding. The vulcanizing molding is generally conducted by heating at a temperature of 135° to 170° C., preferably 140° to 165° C., under pressure for 5 to 60 minutes, preferably 10 to 50 minutes. In addition, the heating at the time of vulcanizing and molding may be conducted in a single stage, or conducted by changing the temperature in two or more stages.

The core thus obtained has a difference (A-B) in compression deformation A of the core and compression deformation B of the golf ball of within the range of 1.0 to 3.5 mm. The compression deformation A of the core itself, i.e. compression deformation formed by applying a load from 10 kg (initial load) to 130 kg (final load) to the core may be preferably 2.0 to 7.0 mm, particularly 3.5 to 6.0 mm.

The cover is formed from the resin composition prepared by formulating pigments (e.g. titanium dioxide, barium sulfate, etc.) to a thermoplastic elastomer and optionally formulating antioxidants thereto. The cover may have a single-layer structure or a multi-layer (two or more layers) structure.

In the case of the cover having a single-layer structure, an ionomer resin or a mixture of two or more sorts of ionomer resins is preferred as the thermoplastic elastomer. In the case of the cover having a multi-layer (two or more layers) structure, it is preferred to use an ionomer resin, a mixture of two or more sorts of ionomer resins (higher acid ionomer resin is also included in the ionomer resin) or a mixture of the ionomer resin and thermoplastic resin (e.g. polyamide, polyurethane, polyester, etc.) is used as the thermoplastic elastomer for the inner layer cover. It is preferred to use a mixture of the ionomer resin and terpolymer type soft ionomer resin as the thermoplastic resin for the outer layer cover.

It is preferred that a stiffness modulus of the cover composition constituting the cover is 1,000 to 6,000 kg/cm$^2$. The stiffness modulus is determined according to ASTM D-747. When the stiffness modulus of the cover composition is smaller than 1,000 kg/cm$^2$, the rebound characteristics are deteriorated and long flight distance is not easily attained. On the other hand, when the stiffness modulus of the cover composition exceeds 6,000 kg/cm$^2$, the cover is too hard and shot feel is inferior and, therefore, durability is likely to be deteriorated. In the present invention, the stiffness modulus of the cover composition is used in place of the stiffness modulus of the cover. The reason is as follows. That is, once the golf ball is produced, the stiffness modulus of the cover of the golf ball is difficult to measure using a current technique and, therefore, the measurement of the stiffness modulus must be conducted after producing a sample from the cover composition. Accordingly, the stiffness modulus is not determined from the cover of the actual golf ball, but the stiffness modulus of the cover and that of a sample formed from the cover composition are considered to be substantially the same.

When the cover having a structure of two or more layers is used, the stiffness modulus of the outer layer cover is adjusted to comparatively low value such as about 1,000 to 2,500 kg/cm$^2$ and the stiffness modulus of the outre layer cover is adjusted to comparatively high value such as about 3,000 to 6,000 kg/cm$^2$, the controllability and shot feel can be improved without decreasing flight distance, and it is particularly preferred.

It is preferred that a thickness of the cover (e.g. total thickness in case that the cover has a multi-layer structure (two or more layers), and mere thickness of the cover in case that the cover has a single-layer structure) is within a range of 2.5 to 5.0 mm. When the thickness of the cover is less than 2.5 mm, it may be impossible to obtain a desired difference in compression deformation between the core and golf ball. On the other hand, when the thickness of the cover exceeds 5.0 mm, the rebound characteristics and shot feel are deteriorated.

A method of covering the core with the cover is not specifically limited, but may be a conventional method. For example, there can be used a method comprising molding a cover composition into a semi-spherical half-shell in advance, covering a core with two half-shells, followed by pressure molding at 130° to 170° C. for 1 to 15 minutes, or a method comprising injection molding the cover composition directly on the core. In addition, when the cover has a multi-layer structure (e.g. two or more layers), the cover may be formed by repeating the same means as those described above. At the time of the cover molding, dimples may be optionally formed on the surface of the golf ball. In addition, after the cover molding, painting, marking, etc. may be optionally provided.

Then, a typical embodiment of the solid golf ball of the present invention will be explained with reference to the accompanying drawing.

FIG. 1 is a schematic cross section illustrating one embodiment of the solid golf ball of the present invention. The solid golf ball shown in FIG. 1 is a two-piece solid golf ball comprising a core 1 of a vulcanized molded article of a rubber composition and a cover 2 for covering the core. The core 1 is referred to as a solid core, and is not limited to a specific one. For example, a vulcanized molded article of the rubber composition containing the above polybutadiene as the main material is used. The cover 2 for covering the core is not also limited to a specific one. For example, it is formed from the above cover composition. In the present invention, it is necessary that the difference (A–B) between compression deformation A of the above core 1 and compression deformation B of the golf ball after formation of the cover is within the range of 1.0 to 3.5 mm.

Figure 2:
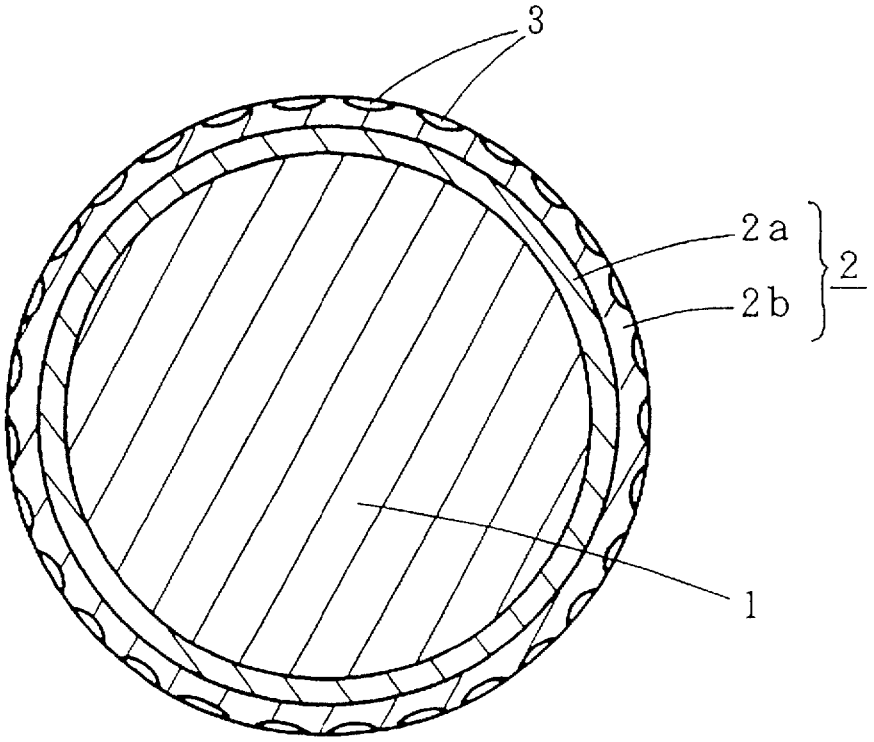
FIG. 2 is a schematic cross section illustrating another embodiment of the solid golf ball of the present invention.

FIG. 2 is a schematic cross section illustrating another embodiment of the solid golf ball of the present invention. Regarding the solid golf ball shown in FIG. 2, a cover 2 for covering a core 1 is composed of two layers, e.g. an inner layer cover 2*a* and an outer layer cover 2*b*. Also, in this case, it is necessary that the difference (A–B) between compression deformation A of the above core 1 and compression deformation B of the golf ball is within the range of 1.0 to 3.5 mm. Regarding both solid golf balls shown in FIG. 1 and in FIG. 2, the core 1 is composed of the single-layer vulcanized molded product of the rubber composition. However, the cores may be composed of the multi-layer (two or more layers) vulcanized molded article of the rubber composition if the above (A–B) is within the above range of 1.0 to 3.5 mm, and an intermediate layer may be provided between the core 1 and cover 2.

In FIG. 1 and FIG. 2, 3 indicates dimples and suitable number/embodiment of dimples 3 may be optionally provided on the cover 2 so as to obtain the desired characteristics. In addition, painting, marking, etc. may be optionally provided on the surface of these golf balls.

As described above, according to the present invention, there could be provided a solid golf ball which is superior in feeling and attains large flight distance.

EXAMPLES

The following Examples and Comparative Examples further illustrate the present invention in detail but are not to be construed to limit the scope thereof.

Examples 1 to 4 and Comparative Examples 1 to 2

A composition for core was prepared according to the formulation shown in Table 1. The resulting composition for core was charged in a die for core, heated at 140° C. for 30 minutes and then heated at 170° C. for 10 minutes under pressure to produce cores a to d having a diameter described in Table 1, respectively. The units of the amount of the respective components described in Table 1 are parts by weight.

The compression deformation A formed by applying a load of 10 kg/cm$^2$ (initial load) to 130 kg/cm$^2$ (final load) to the resulting core was measured. The results are shown in Table 1.

TABLE 1

| | a | b | c | d |
|---|---|---|---|---|
| Formulation: | | | | |
| BR-01 *1 | 100 | 100 | 100 | 100 |
| Zinc acrylate | 15 | 20 | 23 | 30 |
| Zinc oxide | 35 | 31 | 25 | 20 |
| Antioxidant *2 | 0.5 | 0.5 | 0.5 | 0.5 |
| Dicumyl peroxide | 1.0 | 1.0 | 1.0 | 1.0 |
| Diameter of core (mm) | 33.7 | 35.5 | 36.9 | 38.1 |
| Compression deformation A (mm) | 5.5 | 4.6 | 4.3 | 3.0 |

*1: Trade name, high-cis butadiene, manufactured by Japan Synthetic Rubber Co., Ltd.
*2: Yoshinox 425 (trade name), manufactured by Yoshitomi Seiyaku Co., Ltd.

Then, cover compositions I to IV were prepared according to the formulation shown in Table 2, and the stiffness modulus of the resulting cover compositions was measured, respectively. The results are shown in Table 2. Further, the stiffness modulus of the cover composition was measured as follows. That is, the cover composition was subjected to hot press molding to produce a sheet having an thickness of about 2 mm and, after standing at 23° C. for two weeks, the stiffness modulus was measured according to ASTM D-747. In addition, the units of the amount of the respective components described in Table 2 are also parts by weight.

TABLE 2

| | I | II | III | IV |
|---|---|---|---|---|
| Formulation: | | | | |
| Hi-milan 1605 *3 | 0 | 60 | 0 | 0 |
| Hi-milan 1650 *4 | 50 | 40 | 0 | 0 |
| Hi-milan 1706 *5 | 0 | 0 | 0 | 80 |
| Hi-milan 1855 *6 | 50 | 0 | 0 | 0 |
| Surlyn AM7317 *7 | 0 | 0 | 50 | 0 |
| Surlyn AM7318 *8 | 0 | 0 | 50 | 0 |
| Glirax R-6500 *9 | 0 | 0 | 0 | 20 |
| Titanium dioxide | 2 | 2 | 2 | 2 |
| Stiffness modulus (kg/cm$^2$) | 1,300 | 3,000 | 4,300 | 5,800 |

*3: Hi-milan 1605 (trade name): ethylene-methacrylic acid copolymer ionomer resin obtained by neutralizing with sodium ion, manufactured by Mitsui Du Pont Polychemical Co., stiffness modulus: about 3,800 kg/cm$^2$, Shore D-scale hardness: 62
*4: Hi-milan 1650 (trade name): ethylene-methacrylic acid copolymer ionomer resin obtained by neutralizing with sodium ion, manufactured by Mitsui Du Pont Polychemical Co., stiffness modulus: about 2,700 kg/cm$^2$, Shore D-scale hardness: 58
*5: Hi-milan 1706 (trade name): ethylene-methacrylic acid copolymer ionomer resin obtained by neutralizing with zinc ion, manufactured by Mitsui Du Pont Polychemical Co., stiffness modulus: about 3,400 kg/cm$^2$, Shore D-scale hardness: 61

TABLE 2-continued

| | I | II | III | IV |
|---|---|---|---|---|

*6: Hi-milan 1855 (trade name): ethylene-methacrylic acid-acrylate terpolymer ionomer resin obtained by neutralizing with zinc ion, manufactured by Mitsui Du Pont Polychemical Co., stiffness modulus: about 900 kg/cm$^2$, Shore D-scale hardness: 55
*7: Surlyn AM7317 (trade name): ethylene-methacrylic acid copolymer ionomer resin obtained by neutralizing with zinc ion, manufactured by Du Pont U.S.A. Co., stiffness modulus: about 3,600 kg/cm$^2$, Shore D-scale hardness: 64
*8: Surlyn AM7318 (trade name): ethylene-methacrylic acid copolymer ionomer resin obtained by neutralizing with sodium ion, manufactured by Du Pont U.S.A. Co., stiffness modulus: about 4,100 kg/cm$^2$, Shore D-scale hardness: 65
*9: Glirax R-6500 (trade name): polyamide elastomer, manufactured by Dainippon Ink Co., Ltd.

The above core was covered with the cover composition thus prepared as described above, followed by painting to produce a solid golf ball having an outer diameter of 42.7 mm and a weight of 45.4 g. A combination of the core and cover is as shown in Table 3.

Further, in Examples 3 and 4, the cover having a two-layer structure of inner and outer layer covers were used. The core was covered with the cover by injection molding.

TABLE 3

| | Example No. | | | | Comparative Example No. | |
|---|---|---|---|---|---|---|
| | 1 | 2 | 3 | 4 | 1 | 2 |
| Core | c | a | c | b | d | a |
| Cover | II | III | — | — | II | IV |
| Thickness (mm) | 2.9 | 4.5 | — | — | 2.3 | 4.5 |
| Inner layer cover | — | — | III | IV | — | — |
| Thickness (mm) | — | — | 1.3 | 1.7 | — | — |
| Outer layer cover | — | — | I | I | — | — |
| Thickness of outer layer cover (mm) | — | — | 1.6 | 1.9 | — | — |
| Total thickness of inner and outer layer covers (mm) | — | — | 2.9 | 3.6 | — | — |

The compression deformation B, launch angle, spin amount, flight distance (carry) and shot feel of the resulting golf ball were examined. The results are shown in Table 4. Further, the measuring method or evaluation method of the above ball characteristics is as follows.

Compression deformation B:

A compression deformation formed by applying a load from 10 kg (initial load) to 130 kg (final load) to a golf ball is measured.

Launch angle:

A No. 1 wood club is mounted to a swing robot manufactured by True Temper Co., and then a golf ball is hit at a head speed of 45 m/second to measure an angle of the hit golf ball from the horizon.

Spin amount:

A No. 1 wood club is mounted to a Swing robot manufactured by True Temper Co., and then a golf ball is hit with a head speed of 45 m/second. The photograph of the hit golf ball is continuously taken to determine the spin amount.

Flight distance:

A No. 1 wood club is mounted to a Swing robot manufactured by True Temper Co., and then a golf ball is hit at a head speed of 45 m/second to measure a distance to the dropping point.

Shot feel

It is evaluated by hitting a golf ball with a No. 1 wood club due to 10 top professional golfers. The evaluation criteria are as follows. The results shown in the Tables below are based on the fact that not less than 8 out of 10 professional golfers evaluated with the same criterion about each test item.

Evaluation criteria

⊙: Excellent

○: Good

Δ: Slightly inferior

X: Inferior

The ball characteristics measured or evaluated as described above are shown in Table 4. In addition to them, the compression deformation A of the core and difference between the above compression deformation and compression deformation of B the golf ball are also shown in Table 4.

TABLE 4

| | Example No. | | | | Comparative Example No. | |
|---|---|---|---|---|---|---|
| | 1 | 2 | 3 | 4 | 1 | 2 |
| Compression deformation A (mm) | 4.3 | 5.5 | 4.3 | 4.6 | 3.0 | 5.5 |
| Compression deformation B (mm) | 3.0 | 2.5 | 2.9 | 2.3 | 2.8 | 1.7 |
| A–B (mm) | 1.3 | 3.0 | 1.4 | 2.3 | 0.2 | 3.8 |
| Launch angle (°C.) | 11.3 | 12.1 | 11.5 | 11.6 | 10.5 | 12.3 |
| Spin amount (rpm) | 2700 | 2400 | 2500 | 2500 | 2900 | 2200 |
| Flight distance (yard) | 222 | 224 | 222 | 225 | 220 | 218 |
| Shot feel | ○ | ○ | ⊙ | ⊙ | Δ | X |

As is apparent from a comparison between ball characteristics of Examples 1 to 4 and those of Comparative Examples 1 to 2 shown in Table 4, the golf balls of Examples 1 to 4 wherein (A–B), i.e. difference between the compression deformation A of the core and compression deformation B of the golf ball is within the range of 1.0 to 3.5 mm were superior in feeling and attained longer flight distance. Among them, the golf balls of Examples 3 to 4 wherein the cover was composed of two layers and composition I for cover having a low stiffness modulus was used as the outer layer cover were particularly superior in feeling.

To the contrary, regarding the golf ball of Comparative Example 1, the difference between the compression deformation A of the core and compression deformation B of the golf ball (A–B) is small such as 0.2 mm and, therefore, the launch angle was small and the spin amount is large. Accordingly, flight distance is small and shot feel was not good. Regarding the golf ball of Comparative Example 2, the difference between the compression deformation A of the core and compression deformation B of the golf ball (A–B) is too large such as 3.8 mm and, therefore, the spin amount became small. Accordingly, the golf ball stalled to decrease flight distance, and shot feel is also inferior.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A solid golf ball comprising a core having a diameter of 33.7 to 38.1 mm and a cover covering said core having a thickness of 2.5 to 5.0 mm, wherein, when a compression deformation formed by applying a load of from 10 kg (initial load) to 130 kg (final load) to the core taken as the compression deformation A and a compression deformation formed by applying a load from 10 kg (initial load) to 130 Kg (final load) to the golf ball is taken as compression deformation B, the difference (A–B) between compression deformation A and compression deformation B falls within the range of 1.0 to 3.5 mm.

2. The solid golf ball according to claim 1, wherein the cover has a stiffness modulus of within the range of 1,000 to 6,000 kg/cm$^2$.

* * * * *